US007650868B2

(12) United States Patent
Fujita et al.

(10) Patent No.: US 7,650,868 B2
(45) Date of Patent: Jan. 26, 2010

(54) RECOIL STARTER

(75) Inventors: Hirotoshi Fujita, Tokyo (JP); Shuhei Tsunoda, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 12/016,254

(22) Filed: Jan. 18, 2008

(65) Prior Publication Data

US 2008/0173272 A1 Jul. 24, 2008

(30) Foreign Application Priority Data

Jan. 24, 2007 (JP) ..... P2007-014237

(51) Int. Cl.
*F02N 1/00* (2006.01)

(52) U.S. Cl. ..... 123/185.14; 123/185.3

(58) Field of Classification Search ..... 123/185.14, 123/185.2, 185.3, 185.5; 185/41 A; 74/9
See application file for complete search history.

(56) References Cited

U.S. PATENT DOCUMENTS 1,066,014 A * 7/1913 Hodgkinson ..... 123/185.3
2,976,959 A * 3/1961 Husted ..... 188/82.7
6,901,899 B2 * 6/2005 Tsunoda et al. ..... 123/185.14

FOREIGN PATENT DOCUMENTS

JP 2001-132591 5/2001

* cited by examiner

*Primary Examiner*—Stephen K Cronin
*Assistant Examiner*—Anthony L Bacon
(74) *Attorney, Agent, or Firm*—Nixon & Vanderhye P.C.

(57) ABSTRACT

A recoil starter includes a case with a support shaft formed thereon; a rope reel rotatably disposed on the support shaft; a recoil rope wound on the rope reel; a recoil spring that rotationally energizes the rope reel; a cam of an engine side; a power storing spring interposed between the rope reel and the cam; and a ratchet mechanism interposed between the rope reel and the cam. The ratchet mechanism includes: a ratchet shaft formed on the rope reel, a ratchet member having: a base portion oscillatably and slidably supported through an elongated hole on the ratchet shaft, and a ratchet pawl engageable with an engaging portion of the cam, and an energizer that energizes the base portion toward an uneven inner peripheral surface of the case.

2 Claims, 4 Drawing Sheets

RECOIL STARTER

CROSS-REFERENCE TO RELATED APPLICATIONS

The entire disclosure of Japanese Patent Application No. 2007-014237 filed on Jan. 24, 2007 including specification, claims, drawings and abstract is incorporated herein by reference in its entirety.

BACKGROUND OF THE INVENTION

1. Field of the Invention

An aspect of the present invention relates to a recoil starter for starting an engine.

2. Background Art

There is known a recoil starter structured such that a recoil rope wound around a rope reel is pulled to thereby rotate a rope reel. The rotation power of a cam to be rotated by the rotation of the rope reel is transmitted through a clutch mechanism such as a centrifugal clutch to a rotary member such as a flywheel magnet or a drive pulley connected to the crank shaft of an engine. The crank shaft of the engine is rotated through the rotary member to thereby start the engine. This type of recoil starter includes a shock absorbing and power storing member interposed between the rope reel and cam. The shock absorbing and power storing member is used to prevent an impact due to a sudden variation in a load on the engine side from being transmitted to the rope reel side. The rotation power of the rope reel is stored in the shock absorbing and power storing member, and the rotation power stored in the shock absorbing and power storing member is released to thereby facilitate the start of the engine (for example, see JP-A-2001-132591).

The above-mentioned mechanism is structured such that the rope reel to be rotated by pulling the recoil rope, the cam for transmitting the rotation power of the rope reel through the clutch mechanism to the drive pulley connected to the crank shaft of the engine, and a spring case storing therein a spring serving as the shock absorbing and power storing member are respectively rotatably supported by a support shaft provided within the case. Between the rope reel and spring case, there is interposed a one-way ratchet mechanism to thereby transmit the engine start direction rotation power of the rope reel to the spring case. When the rope reel is rotated by pulling the recoil rope, the spring case is rotated integrally with the rope reel through the one-way direction ratchet mechanism to transmit the rotation power of the rope reel to the drive pulley through the spring case. When the rotation of the drive pulley is caused to stop due to the start resistance of the engine, the rotation power of the rope reel can be stored in the spring. In order to prevent the spring case from rotating in the opposite direction, a one-way clutch is disposed between the support shaft and spring case.

According to the above-mentioned technology, the spring case storing therein the spring serving as the shock absorbing and power storing member, the rope reel having the recoil rope wound thereon, and the drive pulley for transmitting the rotation power of the rope reel to the crank shaft of the engine are respectively rotatably supported on the support shaft disposed within the case. Between the rope reel and spring case, there is interposed the one-way ratchet mechanism for transmitting the rotation power of the rope reel in the engine start direction to the spring case, and between the spring case and support shaft, there is interposed the one-way clutch for rotating the spring case only in the engine start direction. Thus, there are a large number of parts, and the structure is complicated. This results not only in an increased cost of the recoil starter but also in the increased dimension of the outside diameter shape thereof, especially, the increased axial direction dimension thereof, which retards the downsizing and weight reduction of the recoil starter.

SUMMARY OF THE INVENTION

An object of the prevent invention is to provide a recoil starter capable of easily starting an engine and to reduce the number of parts to thereby reduce the cost, size and weight of the recoil starter.

According to an aspect of the present invention, there is provided a recoil starter including: a case that is disposed on an engine and that includes a reel support shaft formed thereon; a rope reel rotatably disposed on the reel support shaft; a recoil rope wound on an outer peripheral portion of the rope reel to rotate the rope reel in an engine start direction; a recoil spring that rotationally energizes the rope reel in an opposite direction of the engine start direction to rewind the recoil rope; a cam engaged with a drive pulley connected to an engine through a clutch mechanism to transmit a rotation power of the rope reel to the drive pulley; a power storing spring interposed between the rope reel and the cam; and a ratchet mechanism interposed between the rope reel and the cam; wherein the ratchet mechanism separates the rope reel and the cam from each other when the rope reel is rotated in the engine start direction; wherein the ratchet mechanism connects together the rope reel and the cam when the rope reel is rotated in the opposite direction to the engine staff direction; wherein the ratchet mechanism includes: a support shaft formed on a side surface of the rope reel, a ratchet member having: a base portion formed in one end portion thereof as is oscillatably and slidably supported through an elongated hole on the support shaft, and a ratchet pawl formed on the other end portion thereof and engageable with an engaging portion disposed on an outer peripheral portion of the cam, and an energizer that energizes the base portion so that the base portion is slidingly contacted with an inner peripheral surface of the case.

The inner peripheral surface of the case may include uneven surfaces successively formed thereon.

The inner peripheral surface of the case may include a plurality of concaves successively formed thereon at intervals.

According to another aspect of the present invention, there is provided a recoil starter including: a case including: a reel support shaft formed thereon, and an inner peripheral surface formed unevenly; a rope reel rotatably disposed on the reel support shaft; a recoil rope wound on an outer peripheral portion of the rope reel to rotate the rope reel in an engine start direction; a recoil spring that rotationally energizes the rope reel in an opposite direction of the engine start direction; a cam that is configured to be engaged with an engine through a clutch mechanism and that has a recess disposed on an outer peripheral portion thereof; a power storing spring interposed between the rope reel and the cam; a ratchet shaft formed on the rope reel; a ratchet member including: a base portion that is formed on one end of the ratchet member and that has an elongated hole to be oscillatably connected with the ratchet shaft, and a ratchet pawl formed on the other end of the ratchet member to be engaged with the recess of the cam when the rope reel rotates in the opposite direction; and an energizer that energizes the base portion so that the base portion is slidingly contacted with the inner peripheral surface.

BRIEF DESCRIPTION OF THE DRAWINGS

Embodiments may be described in detail with reference to the accompanying drawings, in which.

DETAILED DESCRIPTION OF THE EMBODIMENTS

Figure 1:
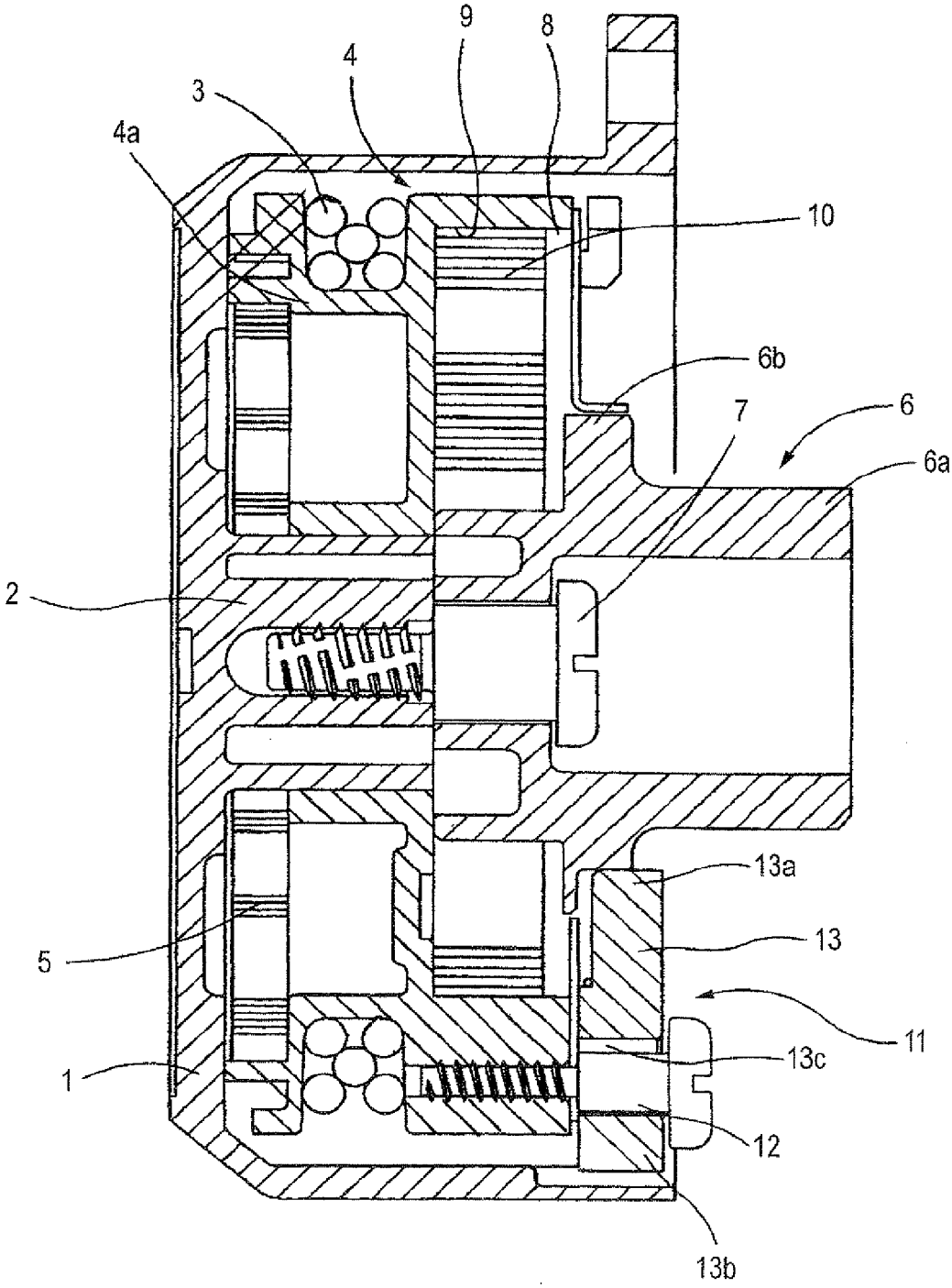
FIG. 1 shows a longitudinal side section view of a recoil starter according to an embodiment.

Description will be given below of an embodiment according to the invention with reference to FIGS. 1 to 6. FIG. 1 shows a longitudinal side section view of a recoil starter according to an embodiment. As shown in FIG. 1, a case 1 of the recoil starter is structured so as to store the main structure of the recoil starter thereinside and cover the side surface portion of an engine. On an inside surface of the case 1, a reel support shaft 2 is provided in such a manner that it is opposed to the crank shaft (not shown) of the engine. On the reel support shaft 2, a rope reel 4 is rotatably mounted. On the outer periphery of the rope reel 4, a recoil rope 3 is wound.

The recoil rope 3 is wound on the reel portion 4*a* of the rope reel 4 formed on the outer periphery thereof. The one end side of the recoil rope 3 is fixed to the rope reel 4. The other end side of the recoil rope 3 is drawn out externally of the case 1 (see FIG. 2). When the other end side of the recoil rope 3 is pulled, the rope reel 4 can be driven and rotated about the reel support shaft 2.

Between the side surface of the rope reel 4 and the outer peripheral surface of the base portion of the reel support shaft 2 provided on the inner surface of the case 1, there is interposed a recoil spring 5 for rotating the rope reel 4, which has been rotated in the engine start direction by pulling the recoil rope 3, in the opposite direction to the engine start direction to thereby rewind the recoil rope 3 drawn out from the reel portion 4*a* onto the rope reel 4 again.

One end portion of the inner peripheral side of the recoil spring 5 is fixed to the reel support shaft 2, while the other end portion of the outer peripheral side thereof is fixed to the rope reel 4. When the recoil rope 3 is pulled to thereby rotate the rope reel 4 in the engine start direction, a rotation power is stored in the recoil spring 5. Using the rotation power stored in the recoil spring 5 by releasing the recoil rope 3, the rope reel 4 is rotated in the opposite direction to thereby rewind the recoil rope 3, which has been drawn out externally of the case 1, onto the rope reel 4 again.

On the leading end side of the reel support shaft 2, there is rotatably mounted a cam 6 including a cam piece 6*a* provided on the outer peripheral surface thereof, while the cam piece 6*a* can be engaged with a clutch mechanism provided on a drive pulley (not shown) which is to be mounted on the crank shaft of the engine. The cam 6 is rotatably supported on the reel support shaft 2 together with the rope reel 4 by a screw 7 which is threadedly engaged with the end portion of the reel support shaft 2.

The clutch mechanism provided on the drive pulley (not shown) is structured as a centrifugal clutch mechanism including a centrifugal ratchet (not shown) which is rotated and energized by a spring in the direction of the cam piece 6*a* provided on the cam 6. When the cam 6 is rotated in the engine start direction, the centrifugal ratchet is engaged with the cam piece 6*a* to thereby rotate the drive pulley in the engine start direction.

When the engine is started and the drive pulley is rotated through the crank shaft (not shown), the centrifugal ratchet (not shown) is rotated due to a centrifugal force against the spring energizing force and is separated apart from the cam piece 6*a* to thereby prevent the rotation power from the engine side from being transmitted to the recoil starter side.

As shown in FIG. 1, in the side surface of the rope reel 4 on the opposite side of the reel portion 4*a*, there is formed a recessed portion 8. In this recessed portion 8, there is stored a power storing spring 10 which constitutes shock absorbing and power storing member. The power storing spring 10, which is stored within the recessed portion 8, is structured such that one end of the outer peripheral side thereof is fixed to the ring-shaped inner peripheral surface 9 of the recessed portion 8 and the end portion of the inner peripheral side thereof is engaged with the cam 6.

The rope reel 4 and cam 6 are connected together through the power storing spring 10, and the rotation power of the rope reel 4 is transmitted through the power storing spring 10 to the cam 6. The engine start resistance prevents the rotation of the cam 6 to generate relative rotation between the cam 6 and rope reel 4, whereby the rotation power of the rope reel 4 is stored into the power storing spring 10.

Figure 2:
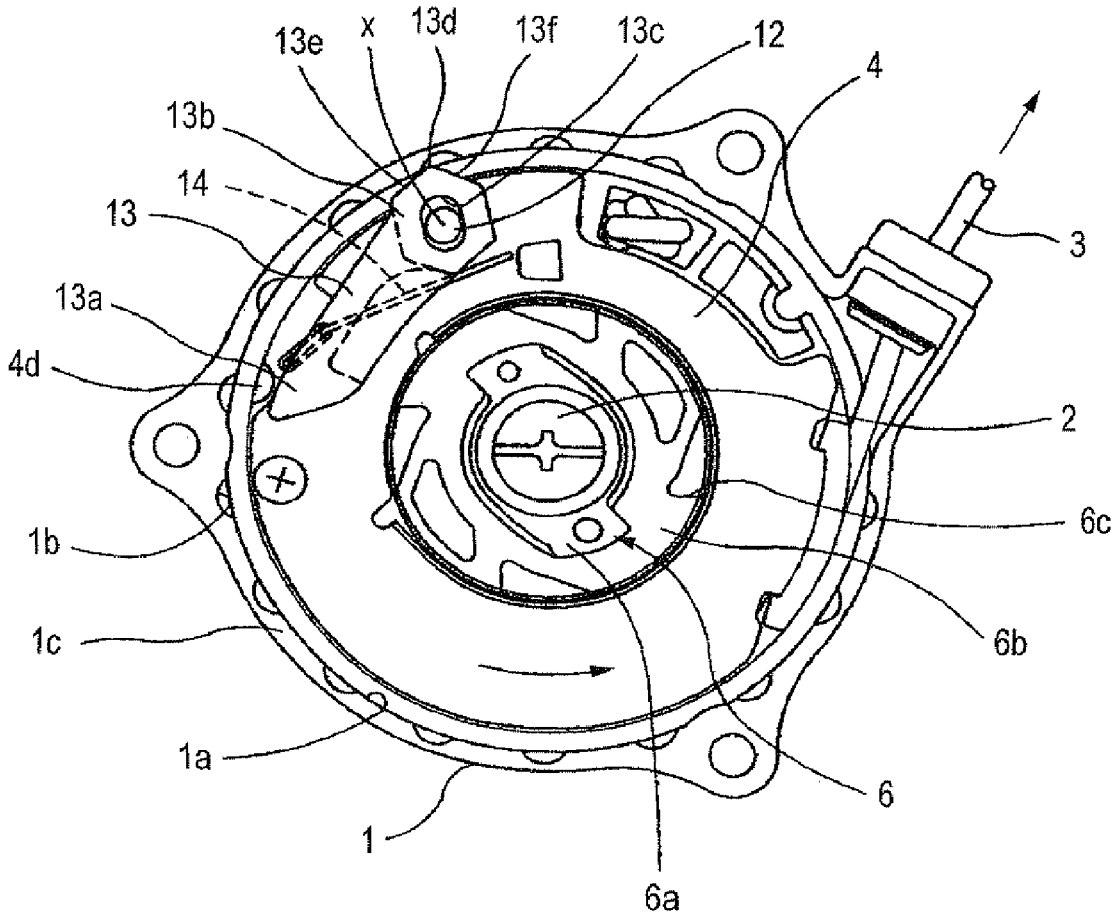
FIG. 2 shows the operation of a ratchet mechanism of the recoil starter according to the embodiment in a state where a recoil rope is pulled and a rope reel is thereby rotated in an engine start direction relative to a cam when the cam is stopped.

As shown in FIGS. 1, 2 and so on, between the cam 6 and rope reel 4, there is interposed a ratchet mechanism 11 which, when the rope reel 4 is rotated in the engine start direction (the arrow mark direction in FIG. 2), is separated from the rope reel 4 and, when the rope reel 4 is rotated in the opposite direction to the engine start direction, is engaged with the rope reel 4 to thereby rotate the cam 6 integrally with the rope reel 4 in the opposite direction to the engine start direction.

The ratchet mechanism 11 is composed of a ratchet member 13 which is oscillatably supported on a support shaft 12 provided on the side surface of the outer peripheral portion of the rope reel 4. When a ratchet pawl 13*a* provided on the leading end of the ratchet member 13 is engaged with one of the engaging surfaces 6*c* of an engaging member 6*b* provided on the outer peripheral surface of the cam 6, the cam 6 can be rotated integrally with the rope reel 4 in the opposite direction to the engine start direction.

The ratchet member 13, as can be understood from FIG. 2 and so on, includes an elongated hole 13*c* formed in its base portion 13*b*. The ratchet member 13 is supported such that, when the elongated hole 13*c* of the base portion 13*b* is fitted over the support shaft 12, the ratchet member 13 can be rotated with the support shaft 12 as its rotation fulcrum X and also can be slid through the elongated hole 13*c* of the base portion 13*b*. The sliding movement of the ratchet member 13 using the elongated hole 13*c* of the base portion 13*b* allows the relative movement of the rotation fulcrum X of the ratchet member 13 substantially in the diameter direction thereof and, in order to attain the relative movement of the rotation fulcrum X in the substantial diameter direction, the elongated hole 13*c* is formed in the above-mentioned one end base portion 13*b* as a hole which, when the ratchet member 13 is provided in the above-mentioned manner, is allowed to extend substantially in the diameter direction.

The base portion 13*b* of the ratchet member 13 has a substantially hexagonal shape; and, the outside thereof, that is, a corner portion 13*d* thereof facing the inner peripheral portion side of the case 1 or the two forming surfaces 13*e*, 13*f* of the corner portion 13*d* are energized by a spring 14 such that it or they can be slidingly contacted with the sliding surface 1*a* of the inner peripheral surface of the case 1.

In the inner peripheral surface of the outer peripheral portion 1*c* of the case 1 with which the corner portion 13*d* of the base portion 13*b* of the ratchet member 13 can be slidingly contacted, there are formed uneven surfaces successively. Each uneven surface is composed of a peripheral surface 1*a* and an arc-shaped recessed portion 1*b*. On the side surface edge portion of the outer peripheral portion of the rope reel 4, there is provided a projection-shaped oscillation restrict portion 4*d* which restricts the oscillation angle of the ratchet pawl 13*a* provided on the leading end of the ratchet member 13.

Figure 3:
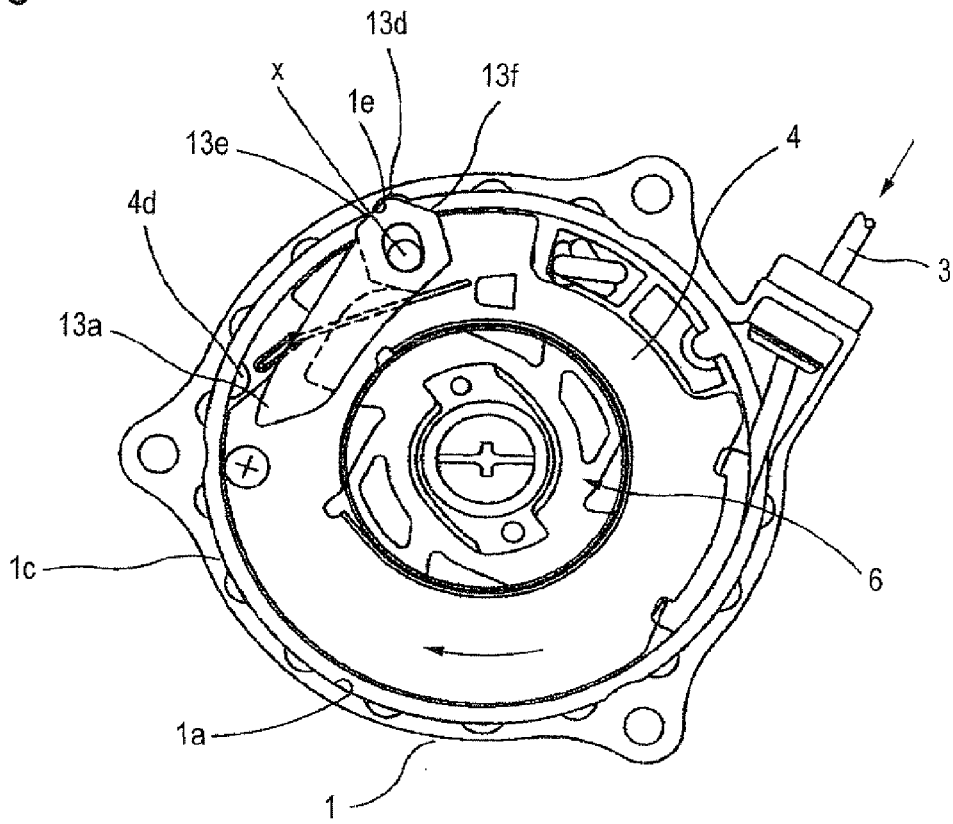
FIG. 3 shows the operation of the ratchet mechanism of the recoil starter in a state just after the pulled-out recoil rope is rewound and the rope reel is thereby started to rotate in the opposite direction to the engine start direction relative to the cam when the cam is stopped.

Therefore, when the rope reel 4 is rotated in the engine start direction by pulling the recoil rope 3, or when the rope reel 4 is rotated in the opposite direction to the engine start direction by rewinding the recoil rope 3 which has been played out once, as shown in FIGS. 2, 3 and so on, the ratchet member 13 is rotated integrally with the rope reel 4: that is, the ratchet member 13 rotates in such a manner that the corner portion 13*b* and its forming surfaces 13*e*, 13*f* respectively energized by the spring 14 are in sliding contact with the arc-shaped recessed portion 1*b* and peripheral surface 1*a* of the inner peripheral portion of the case 1.

Referring to the rotation of the ratchet member 13, owing to the structure which allows the ratchet member 13 to rotate and slide while it is supported on the support shaft 12 engaged with the elongated hole 13*c* of the base portion 13*b* energized by the spring 14, the ratchet member 13 is oscillated through the alternate sliding contact movements of the corner portion 13*d* of the base portion 13*b* or the corner portion forming surfaces 13*e*, 13*f* with the arc-shaped recessed portion 1*b* and peripheral surface 1*a*. The oscillation state of the ratchet member 13 varies variously. As the rope reel 4 is rotated, the ratchet member 13 is allowed to move in the diameter direction with respect to the support shaft 12 due to the operation of the elongated hole 13*c* formed in the base portion 13*b* of one end portion of the ratchet member 13; and, this diameter direction movement of the ratchet member 13 changes the position of the rotation fulcrum X of the moving ratchet member 13 as well as the positions of the sliding contact points of the base portion corner portion 13*d* or corner portion forming surfaces 13*e*, 13*f* with the arc-shaped recessed portion 1*b* and peripheral surface 1*a*. That is, the oscillation state of the ratchet member 13 can vary according to the above-mentioned changes of the positions.

In the rotation of the rope reel 4 in the engine start direction, while the oscillation of the ratchet member 13 is small and the ratchet pawl 13*a* in the leading end portion of the ratchet member 13 is held in a state where it remains in contact with the oscillation restrict member 4*d*. Such holding of the contact state is enabled by the fact that, the rope reel 4 is rotated counterclockwise with respect to the case 1 and the base portion 13*b* of the ratchet member 13 is slidingly contacted with the peripheral surface 1*a* of the inner peripheral portion of the case 1 through the corner portion 13*d* and corner portion forming surface 13*e* to thereby allow the arc-shaped recessed portion 1*b* associated with the peripheral surface 1*a* to rotate the ratchet member 13 clockwise about the support shaft 12.

On the other hand, in the rotation of the rope reel 4 in the opposite direction to the engine start direction, the oscillation of the ratchet member 13 is large up to the limit of the allowable maximum oscillation angle between the position where the ratchet pawl 13*a* of the ratchet member 13 is engaged with the outer peripheral portion of the engaging member 6*b* of the cam 6 and the position where it is contacted with the oscillation restrict member 4*d*. The reason for this large oscillation is that the rope reel 4 rotates clockwise with respect to the case 1, and the base portion 13*b* of the ratchet member 13 is slidingly contacted with the peripheral surface 1*a* of the inner peripheral portion of the case 1 through the corner portion 13*d* and corner portion forming surface 13*f*, whereby the arc-shaped recessed portion 1*b* associated with the peripheral surface 1*a* rotates the ratchet member 13 counterclockwise about the support shaft 12. This large oscillatory movement of the ratchet member 13 is the movement that can engage the ratchet pawl 13*a* formed in leading end portion of the ratchet member 13 with the engaging member 6*b* of the cam 6.

That is, this large oscillatory movement of the ratchet member 13 is an operation by which, as will be discussed later, in a state where a load on the engine side is large and the rotation of the cam 6 is prevented, the ratchet pawl 13*a* for holding the stored power of the wound power storing spring 10 generated due to the mutual rotation between the rope reel 4 and cam 6 can be engaged with one of the engaging surfaces 6*c* of the engaging member 6*b* of the cam 6.

Here, description will be given below of the operation of the recoil starter according to the above-mentioned embodiment with reference to FIGS. 2 to 5.

By the way, in this type of recoil starter, by pulling the recoil rope, the rope reel is rotated in the engine start direction, the cam is rotated through the power storing spring, and the cam piece of the cam is engaged with the centrifugal ratchet to rotate the drive pulley to thereby rotate the crank shaft coupled to the drive pulley. When the rotation load of the drive pulley is increased due to the start resistance of the engine, the rotation of the drive pulley is caused to stop and the rotation of the cam contacted by the centrifugal clutch is also caused to stop; however, the rope reel is further rotated with respect to the cam the rotation of which is stopped, whereby the power storing spring is wound and thus the rotation power is stored into the power storing spring. An impact due to a sudden variation in the load on the engine side can be absorbed by the power storing spring.

In this state, when rewinding the recoil rope which has been pulled out, the rope reel is rotated in the opposite direction to the engine start direction due to the rotation power stored in the power storing spring to thereby rewind the recoil rope.

When pulling the recoil rope 3, the rope reel 4 is rotated counterclockwise in the drawings (in the engine start direction), the ratchet member 13 rotating integrally with the rope reel 4 is rotated while oscillating in such a manner that the outwardly facing corner portion 13*d* or the corner portion forming surfaces 13*e*, 13*f* of the spring energized base portion 13*b* is or are slidingly contacted with the sliding surface of the inner peripheral portion of the outer wall of the case 1 in which the arc-shaped recessed portion 1*b* and peripheral surface 1*a* are formed alternately and successively. This oscillatory movement of the ratchet member 13 is carried out while holding a state where the ratchet pawl 13*a* provided on the leading end portion of the ratchet member 13 remains in contact with the oscillation restrict member 4*d*.

When a rotation load due to the start resistance of the engine side is small and the rotation resistance of the cam 6 is small, the rotation of the rope reel 4 in the engine start direction is transmitted to the cam 6 through the power storing spring 10 while almost not winding the power storing spring 10.

On the other hand, as shown in FIG. 2, when the rotation load due to the start resistance of the engine side is large and the rotation of the cam 6 is prevented, the rotation power of the rope reel 4 in the engine start direction is transmitted to the cam 6 while winding the power storing spring 10. However, until the rotation power composed of the stored power generated by winding the power storing spring 10 increases up to a given amount, the cam 6 cannot be rotated. That is, the rope reel 4 and cam 6 rotate relative to each other and, owing to this rotation of the rope reel 4, the power storing spring 10 is wound to thereby store power therein.

The oscillation of the ratchet member 13 in the above-mentioned rotation of the rope reel 4 is carried out in such a manner that, as described above, the ratchet pawl 13*a* is substantially held in contact with the oscillation restrict member 4*d*; and, therefore, there is no fear that the ratchet pawl 13*a* can be contacted with the outer peripheral portion of the engaging member 6*b* of the cam 6.

Figure 4:
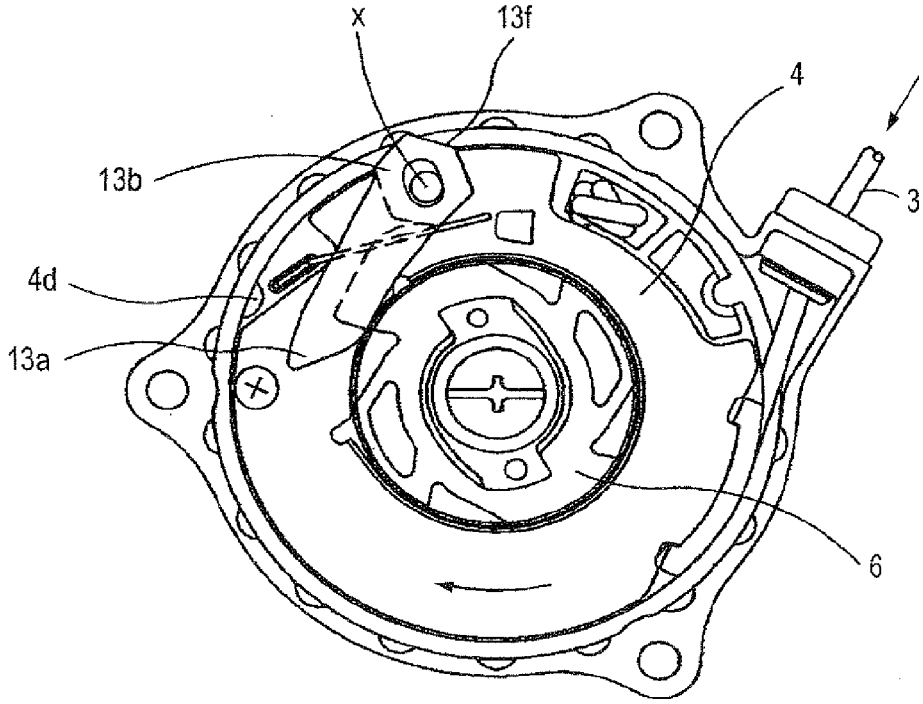
FIG. 4 shows the operation of the ratchet mechanism of the recoil starter in a state just before the oscillating ratchet pawl of a ratchet member is in contact with the engaging surface of the cam.

In the power stored state of the power storing spring 10 where the rope reel 4 and cam 6 have been rotated relative to each other and the power storing spring 10 has been thereby wound, as shown in FIG. 3, when the drawn-out recoil rope 3 is rewound and the rope pulley 4 is thereby rotated in the opposite direction to the engine start direction, as described above, the oscillation of the ratchet member 13 in this rotation becomes large; and, therefore, immediately after this opposite direction rotation is started, as shown in FIG. 4, with the oscillatory movement of the ratchet member 13, the ratchet pawl 13*a* provided on the leading end portion of the ratchet member 13 is contacted with the outer peripheral portion of the engaging member 6*b* of the cam 6.

Figure 5:
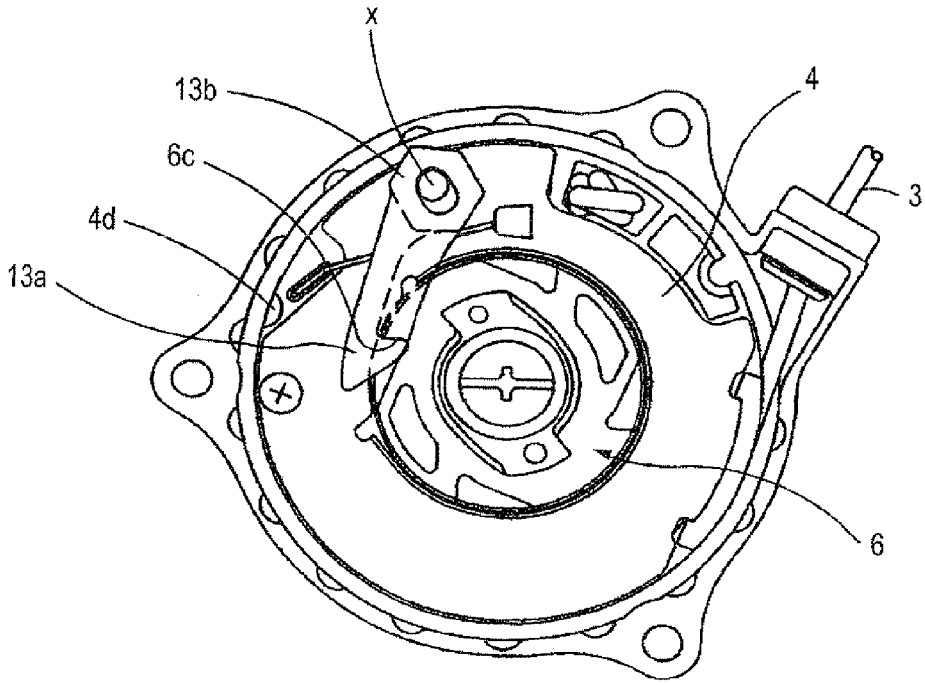
FIG. 5 shows the operation of the ratchet mechanism of the recoil starter in a state where the ratchet pawl is engaged with the engaging surface and the relative rotation of the rope reel and cam is prevented.
Figure 6:
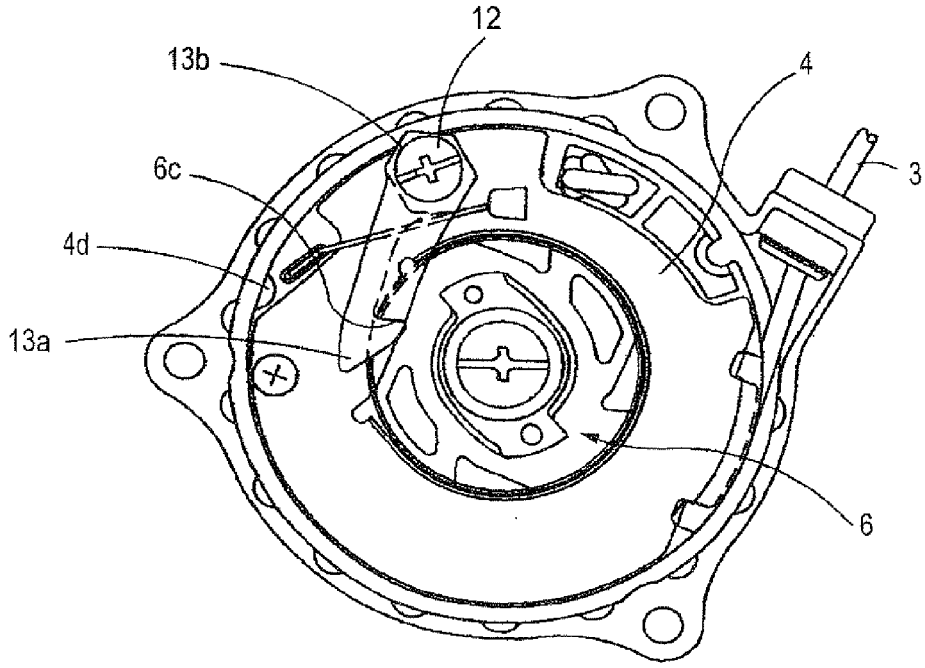
FIG. 6 shows the operation of the ratchet mechanism of the recoil starter in a state where the rope reel and the cam are engaged with each other.

Following the above-mentioned contact of the ratchet pawl 13*a*, as shown in FIG. 5, the ratchet pawl 13*a* is engaged with the engaging surface 6*c* of the engaging member 6*b* of the cam 6. Therefore, the rope reel 4 and cam 6, while maintaining their relative positions shifted due to the above-mentioned relative rotation, are connected together into an integral body, that is, while holding the stored power obtained by the winding of the power storing spring 10, the rope reel 4 and cam 6 are connected together into an integral body and, owing to the operation of the recoil spring 5, the integral body is rotated in the opposite direction, whereby the rope reel 4 is returned to its initial state.

Apart from a case where the engine can be started by pulling the recoil rope 3 only one time, that is, when the engine cannot be started by such one-time recoil rope 3 pulling, the above-mentioned operation to pull the recoil rope 3 is executed again to rotate the rope pulley 4 in the engine start direction to thereby increase the stored power of the power storing spring 10 further; and, using a rotation power based on the thus stored power, the cam 6 is rotated through the power storing spring 10 and is engaged with a centrifugal ratchet (not shown) to thereby start the engine again through the drive pulley.

At that time, when the rotation power based on the stored power of the power storing spring 10 does not yet exceed the start resistance of the engine, the reacting force of the engine start resistance is transmitted to the cam 6 to thereby prevent the rotation of the cam 6. However, as the recoil rope 3 is rewound, the rope reel 4 is rotated again in the opposite direction to the engine start direction to bring the ratchet pawl 13*a* of the ratchet member 13 into engagement with the engaging member 6*b* of the cam 6 to thereby increase the stored power of the power storing spring 10; and, in this power increased state, by pulling the recoil rope 3 further again, the above-mentioned operation is executed repeatedly.

On the other hand, when the rotation power based on the stored power of the power storing spring 10 exceeds the start resistance of the engine, the rotation power of the rope reel 4 and the rotation power stored in the power storing spring 10 are released and transmitted through the cam 6 to the drive pulley (not shown) to rotate the crank shaft at a burst, thereby starting the engine.

According to the recoil starter of the above-mentioned embodiment, the start of the engine can be attained in a shock absorbed condition while making use of the shock absorbing and power storing operation simply by pulling the recoil rope 3 relatively short two or more times. The engine can also be started in a shock absorbed condition while making use of the shock absorbing and power storing operation by pulling the recoil rope 3 relatively long. In this manner, since the pulling length of the recoil rope 3 and the power applying position can be controlled, the engine can be started easily in a shock reduced manner while utilizing the shock absorbing power operation.

The ratchet mechanism 11 is composed of the ratchet member 13 structured such that the base portion 13*b* formed in one end of the ratchet member 13 is supported oscillatably and slidably through the elongated hole 13*c* thereof on the side surface of the outer peripheral portion of the rope reel 4; and, the corner portion 13*b* formed on the outside of the one end base portion 13*b* of the ratchet member 13 or the forming surfaces 13*e*, 13*f* of the corner portion 13*b* is or are pressed and energized by an energizing member so that it or they can be slidingly contacted with the sliding surface of the inner peripheral surface of the outer wall of the case 1. The sliding surface includes the arc-shaped recessed portion 1*b* and peripheral surface 1*a*. In this ratchet mechanism 11, the ratchet pawl 13*a* of the ratchet member 13 can be oscillated according to the rotation direction of the rope reel 4. Therefore, the ratchet pawl 13*a* can be positively engaged with or disengaged from the engaging member 6*b* of the cam 6, thereby being able to carry out a stable operation.

According to an aspect of the present invention, between the rope reel and cam, there is interposed the ratchet mechanism structured such that, when the rope reel is rotated in the engine start direction, it is separated from the cam and, when the rope reel is rotated in the opposite direction, it can be engaged with the cam to thereby rotate the cam in the opposite direction integrally with the rope reel. The present invention can eliminate not only a conventional rotary member such as a spring case which is interposed between the rope reel and cam and can be rotated independently, but also a conventional one-way clutch mechanism for allowing the rotation of the rotary member only in one direction. This can simplify the structure of the present recoil starter as well as can reduce the cost, size and weight thereof.

Further, since the shock absorbing and power storing member is composed of a power storing spring having one end secured to the rope reel with the other end secured to the cam, the shock absorbing capability of the shock absorbing and power storing member can be set large and thus there can be provided a large shock absorbing effect, which makes it possible to start the engine more smoothly. And, the power storing capability thereof can also be set large, whereby a rotation power necessary to start the engine can be stored sufficiently.

Further, the ratchet mechanism is composed of the ratchet member where the one end base portion of which is supported oscillatably and slidably through the elongated hole on the side surface of the outer peripheral portion of the rope reel, and the one end base portion of the ratchet member can be pushed and energized by the energizing member such that it can be slidingly contacted with the inner peripheral surface of the outer wall of the case. Thus, since the sliding contact point of the one end base portion of the ratchet member in the above-mentioned sliding contact operation can be set according to the rotation direction of the rope reel, the ratchet pawl provided on the leading end of the ratchet member can be accurately engaged with and disengaged from the engaging member of the cam, whereby the recoil starter can be operated stably with high reliability.

Further, since the uneven surfaces successively formed in the inner peripheral surface of the case, the ratchet member is allowed to oscillate while it is in sliding contact with the above-mentioned inner peripheral surface.

Further, since the uneven surfaces of the case are composed of the arc-shaped recessed portions which are formed successively at intervals in the inner peripheral surface of the case, the oscillatory motion of the ratchet member, which oscillates in sliding contact with the above-mentioned inner peripheral surface, is accurate, stable and regular. This can enhance further the accuracy of the engagement and disengagement of the ratchet pawl with respect to the cam engaging member according to the rotation direction of the rope reel.

What is claimed is:

1. A recoil starter comprising:

a case that is disposed on an engine and that includes a reel support shaft formed thereon;

a rope reel rotatably disposed on the reel support shaft;

a recoil rope wound on an outer peripheral portion of the rope reel to rotate the rope reel in an engine start direction;

a recoil spring that rotationally energizes the rope reel in an opposite direction of the engine start direction to rewind the recoil rope;

a cam engaged with a drive pulley connected to an engine through a clutch mechanism to transmit a rotation power of the rope reel to the drive pulley;

a power storing spring interposed between the rope reel and the cam; and a ratchet mechanism interposed between the rope reel and the cam;

wherein the ratchet mechanism separates the rope reel and the cam from each other when the rope reel is rotated in the engine start direction;

wherein the ratchet mechanism connects together the rope reel and the cam when the rope reel is rotated in the opposite direction to the engine start direction;

wherein the ratchet mechanism includes:

a support shaft formed on a side surface of the rope reel, a ratchet member having:

a base portion formed in one end portion thereof that is oscillatably and slidably supported through an elongated hole on the support shaft, the elongated hole being substantially aligned with a radius of the rope reel such that a radial line drawn from a center of the rope reel will extend substantially through a long axis of the elongated hole, wherein the base portion and the elongated hole are configured such that oscillation and sliding at the base portion through the elongated hole is effected primarily along the radial line, and wherein the base portion includes a corner portion and corner portion forming surfaces, and a ratchet pawl formed on the other end portion thereof and engageable with an engaging portion disposed on an outer peripheral portion of the cam, and an energizer that energizes the base portion so that the base portion is slidingly contacted with an inner peripheral surface of the case, wherein the inner peripheral surface of the case includes a plurality of concave recesses successively formed thereon at intervals, the energizer including a spring that energizes the base portion toward the inner peripheral surface, wherein when the ratchet member disengages from the cam, when the rope reel rotates in the engine start direction, the ratchet member is pulled away from the cam, and wherein when the ratchet member engages with the cam, when the rope reel rotates in the opposite direction to the engine start direction, the ratchet member is pulled away from the inner peripheral surface of the case.

2. A recoil starter comprising:

a case including:

a reel support shaft formed thereon, and an inner peripheral surface formed unevenly;

a rope reel rotatably disposed on the reel support shaft;

a recoil rope wound on an outer peripheral portion of the rope reel to rotate the rope reel in an engine start direction;

a recoil spring that rotationally energizes the rope reel in an opposite direction of the engine start direction;

a cam that is configured to be engaged with an engine through a clutch mechanism and that has a recess disposed on an outer peripheral portion thereof;

a power storing spring interposed between the rope reel and the cam;

a ratchet shaft formed on the rope reel;

a ratchet member including:

a base portion that is formed on one end of the ratchet member and that has an elongated hole to be oscillatably connected with the ratchet shaft, the elongated hole being substantially aligned with a radius of the rope reel such that a radial line drawn from a center of the rope reel will extend substantially through a long axis of the elongated hole, wherein the base portion and the elongated hole are configured such that oscillation and sliding at the base portion through the elongated hole is effected primarily along the radial line, and wherein the base portion includes a corner portion and corner portion forming surfaces, and a ratchet pawl formed on the other end of the ratchet member to be engaged with the recess of the cam when the rope reel rotates in the opposite direction; and an energizer that energizes the base portion so that the base portion is slidingly contacted with the inner peripheral surface, wherein the inner peripheral surface of the case includes a plurality of concave recesses successively formed thereon at intervals, the energizer including a spring that energizes the base portion toward the inner peripheral surface, wherein when the ratchet member disengages from the cam, when the rope reel rotates in the engine staff direction, the ratchet member is pulled away from the cam, and wherein when the ratchet member engages with the cam, when the rope reel rotates in the opposite direction to the engine staff direction, the ratchet member is pulled away from the inner peripheral surface of the case.

* * * * *